US012747125B2

(12) United States Patent
Celeste et al.

(10) Patent No.: US 12,747,125 B2
(45) Date of Patent: Sep. 29, 2026

(54) DEVICE AND METHOD FOR FEEDING FLAT OBJECTS INTO A TRANSPORT CONTAINER

(71) Applicant: BÖWE SYSTEC GmbH, Augsburg (DE)

(72) Inventors: Ronald Celeste, Kühlenthal (DE); Joachim Koschier, Augsburg (DE)

(73) Assignee: BÖWE SYSTEC GmbH, Augsburg (DE)

( * ) Notice: Subject to any disclaimer, the term of this patent is extended or adjusted under 35 U.S.C. 154(b) by 551 days.

(21) Appl. No.: 18/132,491

(22) Filed: Apr. 10, 2023

(65) Prior Publication Data

US 2024/0336451 A1 Oct. 10, 2024

(51) Int. Cl.
*B65H 31/22* (2006.01)
*B65H 29/18* (2006.01)
(Continued)

(52) U.S. Cl.
CPC ..... *B65H 31/10* (2013.01); *B65H 29/18* (2013.01); *B65H 31/22* (2013.01);
(Continued)

(58) Field of Classification Search
CPC ..... B65H 31/10; B65H 29/18; B65H 31/22; B65H 31/3063; B65H 2301/33222;
(Continued)

(56) References Cited

U.S. PATENT DOCUMENTS 4,019,730 A 4/1977 Staudinger
4,114,351 A 9/1978 Morimoto
(Continued)

FOREIGN PATENT DOCUMENTS

CH 718811 A2 1/2023
DE 28 16 766 A1 10/1978
(Continued)

OTHER PUBLICATIONS

Response to Office Action filed Dec. 21, 2024 for U.S. Appl. No. 18/132,501.
(Continued)

*Primary Examiner* — Thomas A Morrison
(74) *Attorney, Agent, or Firm* — Fleit Intellectual Property Law; Paul D. Bianco

(57) ABSTRACT

A device and a method for feeding flat objects, in particular mail items such as envelopes or letters, in an upright position into a transport container. The device enables to achieve a high productivity and a high automation of the input of a plurality of flat objects and a safe guidance of the transport container by using a first transport device for transporting a transport container in a first transport direction, an input device for transporting flat objects along a second transport direction substantially opposite to the first transport direction, and a second transport device arranged below the first transport device for transporting the transport container in a third transport direction. Between the input device and the
(Continued)

first and second transport device, a receiving device with a container receiver is arranged. The container receiver can be pivoted between a receiving position and a delivery position.

20 Claims, 7 Drawing Sheets

(51) Int. Cl.
*B65H 31/10* (2006.01)
*B65H 31/30* (2006.01)

(52) U.S. Cl.
CPC ..... *B65H 31/3063* (2013.01); *B65H 2301/33222* (2013.01); *B65H 2301/4214* (2013.01); *B65H 2701/1916* (2013.01)

(58) Field of Classification Search
CPC .... B65H 2301/4214; B65H 2701/1916; B65H 31/06; B65H 2301/422548; B65G 57/11
See application file for complete search history.

(56) References Cited

U.S. PATENT DOCUMENTS

| | | | | | |
|---|---|---|---|---|---|
| 4,235,434 | A * | 11/1980 | Muller | B65H 5/002 | 271/305 |
| 4,273,491 | A | 6/1981 | Roux | | |
| 4,441,702 | A | 4/1984 | Nagel | | |
| 4,518,160 | A | 5/1985 | Lambrechts | | |
| 5,672,045 | A * | 9/1997 | Schmid | B65G 57/035 | 414/794.3 |
| 6,594,974 | B2 * | 7/2003 | Theriault | B65H 33/12 | 53/251 |
| 12,325,607 | B2 | 6/2025 | Celeste | | |
| 2004/0098948 | A1 | 5/2004 | Caporali | | |
| 2006/0180434 | A1 | 8/2006 | Arnold | | |
| 2013/0294879 | A1 * | 11/2013 | Middleberg | B65H 33/06 | 414/798.2 |
| 2024/0336452 | A1 | 10/2024 | Celeste | | |

FOREIGN PATENT DOCUMENTS

| | | | |
|---|---|---|---|
| DE | 43 44 744 | A1 | 6/1995 |
| DE | 697 32 629 | T2 | 4/2006 |
| DE | 202021103617 | U1 | 10/2022 |
| DE | 20 2021 103 618 | U1 | 11/2022 |
| DE | 102021117317 | A1 | 1/2023 |
| DE | 102021117320 | A1 | 1/2023 |
| EP | 0 049 718 | A1 | 4/1982 |
| EP | 3 441 150 | A1 | 2/2019 |
| JP | 2008 302 962 | A | 12/2008 |
| JP | 2018-136034 | A | 8/2018 |
| WO | 2012/075520 | A1 | 6/2012 |

OTHER PUBLICATIONS

Office Action dated Oct. 7, 2024 for U.S. Appl. No. 18/132,501.
Result of Examination Report for German Patent Application No. 10 2021 117 317.5, filed Jul. 5, 2021.
Result of Examination Report for German Patent Application No. 10 2021 117 320.5, filed Jul. 5, 2021.
For U.S. Appl. No. 18/132,501: Reply dated Mar. 3, 2025 Notice of Allowance dated Mar. 13, 2025.
Final Office Action dated Jan. 31, 2025 for U.S. Appl. No. 18/132,501, filed Apr. 10, 2023.

* cited by examiner

Fig. 17
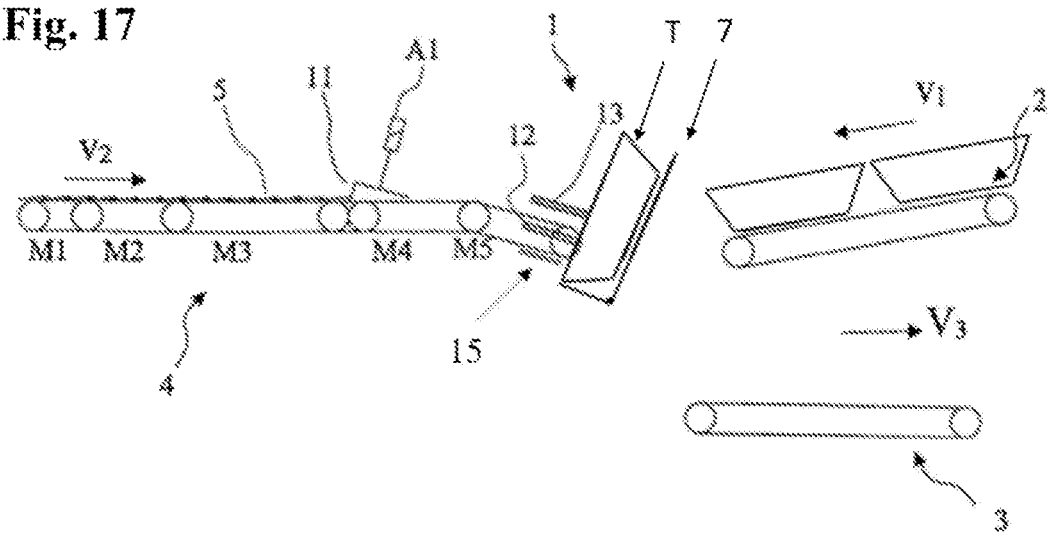
Fig. 18
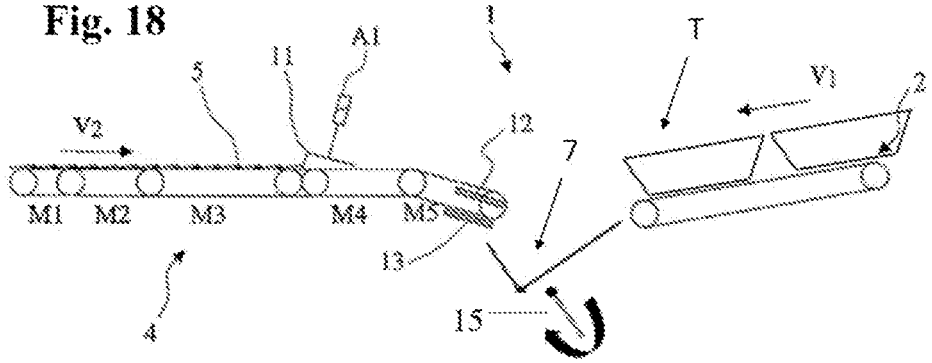
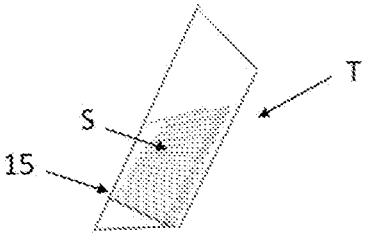
Fig. 19 A
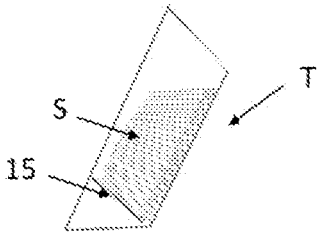
Fig. 19 B

DEVICE AND METHOD FOR FEEDING FLAT OBJECTS INTO A TRANSPORT CONTAINER

FIELD OF THE INVENTION

The invention relates to a device for feeding flat objects, in particular mail items such as envelopes or letters, in an upright or vertical position, into a transport container, and to a method for feeding flat objects in an upright or vertical position into a transport container.

BACKGROUND

Flat objects, such as mail items, in particular letters or envelopes, are normally fed into transport containers for sorting and for further transport, for example after being produced in a printing device, after being inserted in an enveloping device or after being sorted in a sorting device. The objects inserted in a container are then passed on to a further processing point, e.g. a dispatch point for dispatching the mail items to the addresses indicated on the mail items. In order to improve the capacity of a transport container and to facilitate insertion and subsequent removal of the mail items, the mail items are preferably placed in the transport containers in an upright position. A transport container here is understood to be an upwardly open container with a bottom and side walls arranged on the bottom and surrounding it on all sides. Preferably, the transport container is a container with a substantially rectangular bottom and four side walls extending from the bottom. By an "upright position" of the flat objects or the input of the flat objects in an "upright position" here is meant a position of the flat objects in which only a narrow edge of the flat objects, for example the elongated lower edge of an envelope, stands up on the bottom of a transport container. The flat object in an "upright position" thus projects upwards from the bottom of the transport container.

Prior art document U.S. Pat. No. 6,594,974 B2 is disclosing a device for packaging folded shipping packages in sheet form. The packages are moved by a feed device in the direction of a box which is guided at an angle to the feed device and the packages are fed into the box in an upright position. For transporting and positioning the box, a conveyor device is provided in which boxes are preferably manually fed in on an upper side and guided down along an incline and past the feed device. After filling, the boxes are diverted from the fixed incline to a discharge conveyor via a movable contact element resting against the box. For this purpose, the movable contact element rests against the front wall of the box. The contact element supports the box by resting against the front wall during transport of the box along the incline and the associated increasing departure from the incline. As soon as the rear edge of the box has left the incline, the box rotates due to gravity and falls onto the discharge conveyor provided for transporting the box away.

One of the disadvantages of the solutions known from the prior art is that there is no sufficiently controlled guidance of the transport container, in particular due to an intermediate dropping of the filled transport container. As a result, there is a risk of discharge and/or damage to objects placed in the transport container.

SUMMARY

One object of the invention is to provide a device and a method for feeding flat objects, in particular mail items, in an upright position into a transport container, in which a high level of productivity is achieved when feeding the objects into the transport container, a high level of automation of the feeding process is enabled, and the transport container is guided safely and in a controlled manner throughout the entire feeding process. In particular, the device should also be as compact as possible and the flat objects should be fed into the transport container without a risk of falling out of the transport container during the feeding process.

The invention solves the above-mentioned objects with an apparatus and method disclosed herein. Preferred embodiments and useful embodiments of the invention are also disclosed herein.

The device according to the invention for feeding flat objects, such as mail items, envelopes or letters, in an upright position into a transport container comprises a first transport device for transporting a transport container, in particular an empty transport container or a transport container to be filled with a plurality of flat objects, in a first transport direction, an input device for transporting flat objects along a second transport direction essentially opposite to the first transport direction, and a second transport device for transporting the transport container, in particular a filled transport container, in a third transport direction, wherein the second transport device being arranged below the first transport device, preferably essentially directly below the first transport device. Furthermore, a receiving device with a container receiving means for receiving a transport container is arranged between the input device and the transport devices. The container receiving means is designed to at least partially or completely receive a transport container. The container receiving means can be pivoted from a receiving position for receiving a transport container from the first transport device into a delivery position for delivering the transport container to the second transport device. In particular, the container receiving means is swivelled or tilted upward and downward about an axis of rotation perpendicular to the transport directions, when the transport container is transferred form the first transport device to the input device and from the input device to the second transport device, respectively.

The device according to the invention enables an advantageous transport of a transport container to the input device, an advantageous and efficient filling without the risk that objects already inserted into the transport container will fall out of it as well as a simple and fast removal of the transport container from the device. The device further has a compact design. In particular, the transport of the transport containers and their filling with the flat objects can be highly automated with the device and the method according to the invention. In addition, a particularly fast change of transport containers, i.e. the delivery of a filled transport container and the pick-up of a new, empty transport container from the container receiving device and a moving of the container receiving means into an input position for filling the transport container, is enabled. By receiving the transport container with the container receiving means, an advantageous, controlled and safe movement or guidance of the transport container is provided, in particular during the transfer by the first transport device, during the input of the flat objects by the input device and also during the delivery of the filled transport container to the second transport device. In particular, the transport container can be moved in such a controlled manner that flat objects sorted therein are not wholly or partially ejected from the transport container when the container receiving means is pivoted into the delivery position and the transport container is delivered to the second transport device. This enables gentle removal of the transport container with the flat objects inserted therein from the device.

In a preferred embodiment of the device, the first and/or the second transport device are arranged for transporting transport containers in an upright position, i.e. a position that is essentially horizontal or only slightly inclined to the horizontal, with an opening of the transport containers pointing essentially vertically upwards. In the said upright position, the transport container (or more precisely its bottom) preferably encloses an angle of less than 30° with the horizontal, particularly preferably less than 20° and in particular less than 15°. Accordingly, the first transport direction runs essentially parallel to the horizontal or preferably encloses an angle of less than 30°, particularly preferably of less than 20° and in particular less than 15° with the horizontal.

In a preferred embodiment, the first and/or the second transport device can have two lateral boundaries between which the transport containers are guided on a conveyor system, for example on conveyor rollers or a conveyor belt.

In a further preferred embodiment, the container receiving means is arrangeable in an input position in which an input of the flat objects into the transport container arranged in the container receiving means is performed by the input device. In the input position, the transport container is arranged obliquely, i.e. the bottom of the transport container encloses an angle with the horizontal which is preferably smaller than 90°. The input position can correspond to the pick-up position or preferably be a position in which the container receiving means or a transport container contained therein is pivoted at least somewhat further in the direction of the input device compared to the pick-up position. The oblique arrangement of the transport container is to be understood as an arrangement in which the opening of the transport container does not point substantially upwards, but laterally towards a side and in particular at least substantially along a direction pointing towards the input device. In an advantageous embodiment, the bottom of the transport container has an angle with the horizontal between 30° and 90°, preferably between 45° and 80°, particularly preferably between 55° and 75° in the input position. This preferred embodiment provides an advantageous feeding of the flat objects in an upright position into the transport container in its input position.

The pick-up of the transport container from the first transport device into the container receiving means can advantageously take place in such a way that the transport container is initially conveyed from the first transport device to the container receiving means and subsequently slides down into the container receiving means under the force of gravity. The delivery of the transport container from the container receiving means to the second transport device preferably is also gravity-driven, with the container receiving means being pivoted downward in the delivery position to such an extent that a transport container slides out of it. Alternatively, an active dispensing of the transport container from the container receiving means can also be performed by a dispensing device integrally arranged in the receiving device. The dispensing device preferably is comprising a motorized pusher for pushing the filled transport container out of the container receiving means and onto the second transport device.

In a preferred embodiment, the container receiving means is movable, in particular pivotable, from the pick-up position into an input position in which the flat objects can be fed into the transport container by the input device. For bringing the container receiving means from the receiving position into the input position, the container receiving means initially pivots at least somewhat towards the input device. The open top of the transport container then points towards the input device. This enables an advantageous positioning of the transport container with respect to the input device, which ensures a proper and obstruction-free feeding of the flat objects in an upright position into the open top of the container. For the movement of the container receiving means from the receiving position into the input position and later (after a complete filling of the transport container) from the input position into the delivery position, the receiving device preferably has at least one controllable drive means, in particular a motor.

In a further preferred embodiment of the device, the container receiving means can be moved in its input position between an upper input position and a lower input position. In this embodiment, hence the transport container can be moved between an upper input position and a lower input position, while the container receiving means is in its input position. The movement of the container receiving means between the upper input position and the lower input position is preferably conducted by a movement device integrated in the receiving device, which movement device can move the container receiving means up and down. In a preferred embodiment thereof, the angle of the container receiving means or the bottom of the transport container to a vertical direction is not changed during the movement of the container receiving means from the upper to the lower input position.

In an alternative embodiment, the container receiving means may be pivoted relative to the input device during its movement from the upper input position to the lower input position. In particular the container receiving means moves towards the input device or in some circumstances slightly away from the input device, in order to achieve a desired angle for feeding the flat objects into the transport container. By moving the transport container from the upper to the lower input position, an advantageous and trouble-free input of the flat objects in an upright position into the transport container is given, wherein in particular, the flat objects fed towards the transport container are stacked therein on a stack of flat objects, which is resting on a side wall of the transport container (in particular the front side wall of the container, which is facing downwards, when the container is in the input position).

The movement of the container receiving means from the upper to the lower input position preferably takes place in dependence on the input flow of the flat objects transported by the input device towards the receiving device. Advantageously, the movement of the container receiving means takes place as a function of the conveying speed at which the flat objects are moved by the input device in the first transport direction and/or as a function of the number and/or the thickness of a plurality of flat objects to be inserted into the transport container. In a particularly advantageous embodiment, a sensor can also be provided that detects the fill level of the transport container and controls the movement of the container receiving means from the upper to the lower input position as a function of the detected fill level.

In an advantageous embodiment, the input device engages at least partially into a transport container inserted in the container receiving means being in its input position and/or in its receiving position. Particularly, the input device has an input end that is at least slightly extending into a transport container arranged in the container receiving means, during the entire feeding process. This ensures safe feeding and depositing of a plurality of flat objects in an upright position into the transport container.

Preferably, the third transport direction of the second transport device, along which the removal of a filled transport container from the container receiving means towards the second transport device takes place, is substantially parallel to the second transport direction, i.e. the direction along which the flat objects are fed by the input device. Especially, an angle between the third transport direction and the second transport direction is smaller than 45°, in particular smaller than 20°, and is preferably smaller than 10°. This embodiment, in particular together with the arrangement of the second transport device below the first transport device, provides a compact and space-saving design of the device.

In an advantageous embodiment, the container receiving means has a receiving base, on which the bottom of a transport container can be placed, and at least one lower contact wall, on which a first side wall of a transport container can be rested. Preferably, a transport container placed in the container receiving means rests with the front side wall (i.e. the side wall of the transport container which is facing the container receiving means when the transport container is transported in the first transport direction) receiving means continuously against the lower contact wall of the container receiving means, after the transport container has been received by the container receiving means (and also during the insertion of flat objects by the insertion device, up to the delivery of the transport container to the second transport device).

In a preferred embodiment, the lower contact wall of the container receiving means is rigidly connected to the receiving base. In a particularly advantageous embodiment, the container receiving means additionally has at least two lateral contact walls for guiding lateral side walls of the transport container. This embodiment provides a secure guidance of the transport container during the entire transport and feeding process. In an alternative embodiment, the lower contact wall can be designed to be movable relative to the receiving base, in particular displaceable along the receiving base. By moving the lower contact wall along the receiving base, it is possible, for example, to move a transport container arranged in the container receiving means between an upper and a lower input position. For example, a movement of the lower contact wall can also advantageously cause a pick-up of the transport container from the first transport device and/or a pushing of the transport container from the container receiving means to the second transport device. In addition, or as an alternative to the described embodiment, the container receiving means can have a suction device arranged on the receiving base of the container receiving means. Preferably, the suction device is controllable, so that the bottom of a transport container can be sucked by the suction device when a transport container is received by the container receiving means and the transport container can be fixed or held in the container receiving means by the suction device in the time between the pickup of a transport container from the first transport device until the delivery of the transport container to the second transport device. The suction device preferably is comprising a suction strip or a plurality of suction cups, arranged in the receiving base and connected to a vacuum pump, respectively.

In an advantageous embodiment, the input device has a conveyor device, in particular conveyor rollers and/or at least one conveyor belt, for transporting a series of flat objects in a singled arrangement or in a scaled arrangement one above the other. In the scaled arrangement, the flat objects overlap at least partially one another.

The input device preferably is comprising a conveying device with a plurality of conveyor rollers or at least one conveyor belt. The conveyor rollers or the at least one conveyor belt are providing a conveying surface, on which the flat objects are resting during transport, wherein the conveyor rollers or the conveyor belt are driven by a motor for transporting the flat objects linearly in the second transport direction. This embodiment enables a simple and safe serial transport of a series of flat objects along the second transport direction. By controlling the drive or the speed of the conveying device, the speed at which the flat objects are fed by the input device into the transport container can be controlled and regulated. For example, by slowing down the conveying device, a change of transport containers (i.e. the removal of a filled transport container from the container receiving means, a subsequent pick-up of a new, empty transport container and setting the container receiving means back to the input position while holding the new transport container), is possible in a fast and safe manner. This is particularly advantageous in the case of an endless or uninterrupted flow of a series of flat objects to be inserted in a transport container.

In a particularly advantageous embodiment, the input device comprises at least two conveyor sections, preferably at least three, more preferably at least four, and most preferably at least five conveyor sections, which can be operated or driven independently of one another and/or at different speeds. This makes it possible, among other things, to briefly and in a controlled manner delay or interrupt the input of flat objects from an uninterrupted flow of flat objects to be input, whereby a change of transport containers can be carried out, in particular without stopping a transport system upstream of the input device for feeding the flat articles. For example, the input device can have a plurality of conveyor sections, wherein during the change of transport containers, the front conveyor section facing in the direction of the container receiving means is driven faster for a short time and the upstream conveyor sections, along the second transport direction, (as seen from the consecutive conveyor sections) have an increasingly lower speed. As a result, the flat objects brought by the upstream conveying sections are overlapping a little bit, causing the flat objects to lie on top of each other in a scale-like pattern. Due to the faster driving of the upstream conveying section, the flat objects which are still resting on the surface of the conveying device are fed into the (almost completely) filled transport container. Due to the short time required for a change of transport containers, an overlapping of the flat objects is low when the speeds of the conveyor sections are set appropriately, which is why overlapping of the flat objects on the conveying device does not cause any disturbance or blockage and the flat objects scaled on the input device can still be fed into the empty transport container, which subsequently is received by the receiving device in a subsequent feed cycle, without any disturbance caused by the change of transport containers. As soon as the next transport container is inserted in the receiving device in its input position and is ready for filling, the speed of the upstream conveyor sections can be increased again and the speed of the front conveyor section at the same time is reduced so that all conveyor sections have the same speed again. This preferred embodiment of the invention is not limited to a certain number of conveyor sections and the special control described. In particular, the use of only two or more conveyor sections along the second transport direction and a different control of the speeds of the conveyor sections is also possible in order to enable a change of transport containers without having to stop the serial flow of the flat objects in the input device.

In a particularly advantageous embodiment, the input device comprises at least one restraining element, in particular a restraining element arranged between two of the conveyor sections of the conveyor device of the input device. The restraining element also may be insertable between consecutive conveyor sections. The restraining element serves for at least briefly restraining and/or scaling up the flat objects transported by the input device. This allows an interruption or delay of an (uninterrupted) serial flow of the flat objects and thus an uninterrupted change of transport containers.

In a further preferred embodiment, the restraining element is extending transversely to the first transport direction. For example, the restraining element is a restraining plate or a restraining bar extending transversely to the first transport direction and slightly above the conveying surface of the conveying device. The restraining element can also be designed as a rake. Expediently, the restraining element is moved towards the conveying device of the input device by an actuator or a drive for restraining or scaling up the input stream of flat objects. In a particularly preferred embodiment, the restraining element is moved from above onto the conveying device of the input device, in particular onto the conveying surface of the conveying device, or between two conveying sections of the input device. In an alternative embodiment, the retaining element may also be disposed in a space between two neighbouring conveyor sections from below and may thus be introduced to retain the serial flow of flat objects from the bottom up to interrupt the input flow. In a preferred embodiment, the input device has at least two, particularly preferably more than two, conveying sections upstream of the retaining element and at least one conveying section downstream of the retaining element. Due to the at least two conveyor sections, which are arranged upstream of the retaining element (viewed in relation to the second transport direction) and are drivable independently of one another, a controlled deceleration or retention of the flow of flat objects or an associated scaling of the flat objects is enabled by using the retaining element.

In a preferred embodiment, the device according to the invention comprises at least one compression unit for compressing a stack of flat objects input into a transport container. The compression unit expediently comprises at least one compression element insertable into a transport container during feeding of a plurality of flat objects, in particular on top of a stack of flat objects build up in the container. The compression element is adapted for engaging a transport container filled at least partly with a stack of flat objects and is coupled to a drive for moving the compression element into the transport container and out of it. The at least one compression element may comprise one or more compression fingers or a compression pin. By means of an engagement of the at least one compression element into the transport container during the filling process, the loading space of a transport container can be utilized in an optimized way, in that the stack S of flat objects arranged therein in an upright position and resting on the front side wall of the transport container, is compressed by the at least one compression element. For this purpose, the at least one compression element is inserted into the transport container and on top of the stack of flat objects build up therein and are pressed downward on the stack (i.e. towards the front side wall of the transport container, on which the stack is resting).

In a particularly advantageous embodiment of the compression unit, a first compression element is arranged at the front end of the input device pointing in the direction of the container receiving means, specifically in the region of the input device engaging into a transport container arranged in the container receiving means. The first compression element is movable by a drive substantially along the second transport direction, i.e. into or out of the transport container. A compression of the stack of flat objects located in the transport container can preferably be performed with the first compression element extending into the transport container and above the top of the stack, by moving the container receiving means together with the transport container arranged therein upwards. The top of the stack of flat objects in the transport container thereby is pressed against the stationary first compression element extending therein above the top of the stack, whereby the stack of flat objects in the transport container is compressed.

In an advantageous embodiment of the compression unit, in addition to the first compression element, a further compression element of the compression unit is moved into the transport container, as soon as a predefined compression position of the stack is reached. The second compression element, which is arranged on the receiving device and preferably moves up and down together with the container receiving means, is introduced into the transport container. In this case, the first and the second compression elements are designed and arranged in such a way that they do not interfere with each other, in particular also not when the second compressing element moves up and down together with the container receiving means. The compression position is reached, for example, when the second compression element is at the same height level as the first compression element. When this compressing position is reached, the second compression element is inserted into the transport container and onto the top of the stack. The first compression element can then be removed from the transport container, in particular before the transport container is moved downwards. The subsequent series of flat objects is then deposited on the second compression element, which is moved downwards together with the transport container during further filling. Although an interruption or delaying of the introduction of flat objects into the transport container during the compression process is not absolutely necessary in the described embodiment with the first and second compression elements, it is possible to briefly interrupt the feeding. In order to be able to achieve the best possible utilization of the accommodation contingent of the transport container, it is advantageous that the first and the second compression element are designed to be as thin as possible. In particular, the second compression element can be somewhat thinner than the first compression element in order to facilitate insertion of the second compression element. The second compression element can remain in the transport container until it is completely filled with flat objects, and can be removed from the transport container before the container receiving means is pivoted into the delivery position. It is also conceivable that the first compression element is reintroduced into the transport container for further compression and/or that the receiving device has a plurality of compression elements to be introduced into the transport container one after the other.

Alternatively to the described embodiment, a further embodiment is also conceivable in which a compression unit is arranged on or at the input device, in which the compression element is designed to be movable between an upper and a lower position, i.e. essentially along the vertical direction. Thereby, the compression element can be moved first into the transport container above a stack of flat objects arranged therein and afterwards moved downwards for compressing the stack of flat objects. In the further course of inserting flat objects, with subsequent flat objects being inserted above this compression element, the compression element can further be moved downward in synchronization with a downward movement of the transport container. A second compression element arranged on the receiving device and moving downwards together with the container receiving means would no longer be necessary in this embodiment. Furthermore, a further embodiment is also conceivable in which only one compression unit arranged on or at the receiving device is provided, in which a single compression element can be moved at least substantially along the direction of movement of the container receiving means receiving means.

Furthermore, a method for feeding flat objects, in particular mail items such as envelopes or letters, in an upright position into a transport container is disclosed. Preferably, the method is automated by a device according to the embodiments described above. However, the method according to the invention is not limited to be executed in such a device. The method according to the invention comprises the following steps, in particular following each other in the indicated order:

(a) Transport of a transport container by a first transport device along a first transport direction;
(b) Receiving the transport container by a container receiving means positioned in a receiving position;
(c) Feeding of a plurality of flat objects into the transport container by a feeding device designed for transporting a series of flat objects in a second transport direction, which is substantially opposite to the first transport direction;
(d) Swivelling the container receiving means together with the transport container into a delivery position;
(e) delivery of the transport container to a second transport device arranged below the first transport device and designed to transport the transport container in a third transport direction.

The flat objects are thereby serially fed into the transport container in an upright position, i.e. in a position in which a narrow edge of the flat objects, for example the elongated lower edge of an envelope, stands up on the bottom of the transport container. During feeding, the container receiving means is arranged in an input position, which may be the receiving position or a position of the container receiving means pivoted in the direction of the input device as viewed relative to the receiving position. Preferably, the transport container is arranged in the input position in an inclined or at least partially upright position, wherein the inclined or at least partially upright arrangement of the transport container is to be understood as an arrangement in which the open top of the transport container does not point substantially upwards, but towards a side, in this case a front side facing towards the input device. In an advantageous embodiment, the bottom of the transport container has an angle of less than 90° with a horizontal plane, in particular between 30° and 90°, preferably between 45° and 80° and particularly preferably between 55° and 75°, when the transport container is in its input position.

In a particularly preferred method, prior to the input of flat objects, a movement of the container receiving means from the receiving position to an input position provided for the input of the flat objects by the input device takes place. In particular, this can involve pivoting the container receiving means towards the input device and/or moving the container receiving means upwards. These movements ensure an optimum positioning of the transport container for unimpeded input of the flat objects into the transport container by the input device.

In an advantageous embodiment of the method, the container receiving means together with the transport container is moved from an upper input position to a lower input position during the input of the flat objects. The movement preferably takes place essentially along the vertical direction or along a direction slightly inclined to the vertical direction. The movement of the container receiving means from the upper input position to the lower input position provides a safe and cant-free successive input of a series of flat objects as a function of the filling level of the transport container. In a possible embodiment of the method, the angle of the container receiving means to the vertical direction will remain unchanged during the movement from the upper to the lower input position. In an alternative embodiment, the container receiving means can also be pivoted relative to the input device during the movement from the upper to the lower input position, in particular towards the input device or, under certain circumstances, away from the input device, in order to achieve an optimum angle for feeding the flat objects as a function of the fill level of the transport container.

In a preferred embodiment of the method, during a change of transport containers, a delay or interruption of the serial transport of the flat objects fed by the input device and/or a scaling of the flat objects transported by the input device takes place. Thus, a change of transport containers, in particular a removal of a filled transport container from the container receiving means and a subsequent insertion of an empty transport container into the container receiving means is possible in an efficient way.

In an advantageous embodiment of the method, the input device has a retaining element for retaining the series of flat objects transported by the input device and additionally, as viewed in the second transport direction, at least one conveying section arranged upstream of the retaining element and at least one conveying section arranged downstream of the retaining element, wherein during a change of transport containers, the retaining element for retaining the series flat objects transported by the input device is moved to or between the at least two consecutive conveying sections. For this purpose, the restraining element can be moved in particular from above at or between the conveying sections of the input device. In an alternative embodiment, wherein a retaining element is arranged below and/or between two conveying sections, the retaining element may also be moved upwardly from below to retain the series of flat objects, wherein the retaining element thus is brought into the input stream of the flat objects. Further, in this case, the conveying speed of the at least one conveying section arranged upstream of the retaining element is preferably reduced and/or the conveying speed of the at least one conveying section arranged downstream of the retaining element is increased. In a particularly preferred embodiment, at least two, preferably at least three, independently drivable conveying sections are arranged upstream of the restraining element, wherein said conveying sections are operated with decreasing conveying speed during a change of transport containers. The described design allows a particularly efficient change of transport containers, in particular without stopping an infeed system located upstream of the input device that serially feeds the plurality of flat objects to the input device.

Preferably, in the method a step of compressing the flat objects stacked in a transport container further takes place during the input of the flat objects into the container. Particularly preferably, a first compression element arranged on the input device is inserted into the already partially filled transport container and/or a second compression element arranged at or attached to the receiving device is inserted during the input of flat articles. The first compression element arranged on the input device always remains in the same position, as viewed relative to the input device, with the exception of the movement into the transport container. In contrast, the second compression element arranged on the receiving device moves in unison when the container receiving device moves downward between an upper and a lower input position. In a particularly advantageous embodiment, the first compression element is first inserted above a stack of flat objects inserted in the transport container, followed by a subsequent upward movement, of the container receiving means, in particular in a vertical direction, to a compression position at which the first and second compression elements are at the same height. In this case, the first compression element inserted into the transport container rests on the top of the stack of flat objects, in particular when the container receiving means is moved upwards. This results in compression of the stack of flat objects inserted in the transport container. By compressing the stack of flat objects, the receiving contingent of a transport container can be maximally utilized. Subsequently, an insertion of the second compression element into and a removal of the first compression element from the transport container are performed. The second compression element, which is arranged on the receiving device and, in particular, moves along with the container receiving means, can-in contrast to the first compression element being arranged in a fixed position on the input device-remain in the transport container until the end of the feeding of flat objects, as a result of which the achieved compression of the stack of flat objects is maintained. When a certain degree of filling of the transport container is reached and, in particular, before the container receiving means is pivoted into the delivery position, the second compression element is removed from the transport container. In a possible embodiment of the method, during the insertion of the flat objects into the transport container, the described step of compressing can also be repeated several times, specifically by using multiple compression elements.

In an alternative embodiment of the method, it is also conceivable, for compressing the stack of flat objects stacked in a transport container, to provide only one compression unit with a compression element arranged on or near the input device or at the receiving device, wherein the compression element can be moved between an upper and a lower position, in particular independently of the container receiving device. In this case, the compression element is moved into the transport container during the input of the flat objects and is subsequently moved downward for compressing the stack of flat objects developing in the transport container by serially feeding of flat objects. In the further course of the input of the flat objects, the compression element is moved downwards together with the container receiving means and preferably out of the container receiving means before or when the container receiving means is pivoted into the delivery position.

Preferably, after dispensing a filled transport container out of the container receiving means, the container receiving means is moved from the delivery position to the receiving position for receiving the next transport container. For this purpose, the container receiving means in particular is swivelled upward and/or moved vertically upward. This allows to continue with the filling of flat objects into a subsequent transport container.

In a particularly preferred embodiment of the method, the first transport device is driven only for or during the transfer of a transport container from the first transport device to the container receiving means. In particular, driving of the first transport device can be omitted during the time in which the container receiving means is not capable of receiving a subsequent transport container. In a further preferred embodiment of the method, the second transport device is driven only for or during the discharge of a filled transport container delivered by the container receiving means. Alternatively, the second transport device can also be operated permanently.

If transport containers are used which are not cuboidal and, in particular, have inclined side walls which form an angle greater than 90° with the bottom of the transport container (and are thus trapezoidal in a longitudinal section and/or a cross section), it is advantageous if the device comprises a movable base element which can be moved into a transport container located in the container receiving means, for example by retracting or pivoting the base element, before the flat objects are conveyed into the transport container. The base element is arranged in the transport container in such a way that it is located close to and slightly above the (inclined) front side wall of the transport container located in the transport container receiving means. In this position of the base element in the transport container, the base element can serve as a support for a stack of flat objects that is fed into the transport container. The base element thereby prevents the stack of flat objects, which is created on the base element by serially feeding flat objects, from sliding out of the transport container during the stacking of the flat objects in the transport container on the front side wall of the transport container, which is located at the bottom in the container receiving means and is inclined downwards. Advantageously, the base element can be linearly extended and retracted into the transport container by means of a drive.

Preferably, the base element is pivotably arranged on the receiving device at the side of the transport container located in the container receiving means and can be pivoted into and out of the transport container by a pivoting movement. In this case, the base element is expediently formed in two parts, a first part of the base element being formed by a plate pivotably arranged laterally on a first side of the receiving device and a second part of the base element being formed by a second plate pivotably arranged laterally on a second side of the receiving device opposite the first side.

The base element inserted into a transport container serves not only as a support for the stack of flat objects for preventing the stack from sliding out of the transport container during stacking, but also as a fixation of the transport container in the container receiving means, in that the base element inserted into the transport container presses the bottom of the transport container against the container receiving means, in particular against the receiving base of the container receiving means. Such a fixation is particularly advantageous for non-square-shaped transport containers, because with such containers there is a risk that the transport container will slip out of the container receiving means when the container receiving means is swivelled from the receiving position to the input position and/or during filling of the transport container with flat objects, due to the inclination of the (front) side wall of the transport container located at the bottom in the container receiving means.

Expediently, the base element that can be inserted into a transport container is designed to be inclinable with respect to a horizontal plane. In this way, an inclined build-up of the stack of flat objects produced in the transport container and a resulting slipping out of flat objects from the transport container during stacking can be prevented by adjusting the angular position of the base element with respect to a horizontal plane during stacking, in such a way that the upper layers of the stack or the top of the stack lies as far as possible in a horizontal plane. This prevents subsequent flat objects placed on the top of the stack from sliding off the stack and out of the transport container.

BRIEF DESCRIPTION OF THE DRAWINGS

These and further features as well as advantages and effects of the device according to the invention as well as of the method according to the invention become clear from the following disclosure of embodiment examples described in more detail with reference to the accompanying drawings. The drawings show:

FIG. 17: Illustration of a preferred embodiment of the device with a movable base element that can be inserted into a transport container located in the device in an input position, wherein in the Figure the base element is located outside the transport container in an extended position;

FIG. 18: Schematic illustration of a further embodiment of the device with a base element that can be inserted by a pivoting movement into a transport container located in an input position in the device;

FIGS. 19A and 19B: Schematic representation of a transport container in an input position in the device, with a base element located in the transport container and a stack of flat goods arranged on the base element, wherein the base element can be tilted relative to a horizontal plane and is shown in FIGS. 19A and 19B in two different tilting positions.

DETAILED DESCRIPTION

Figure 1:
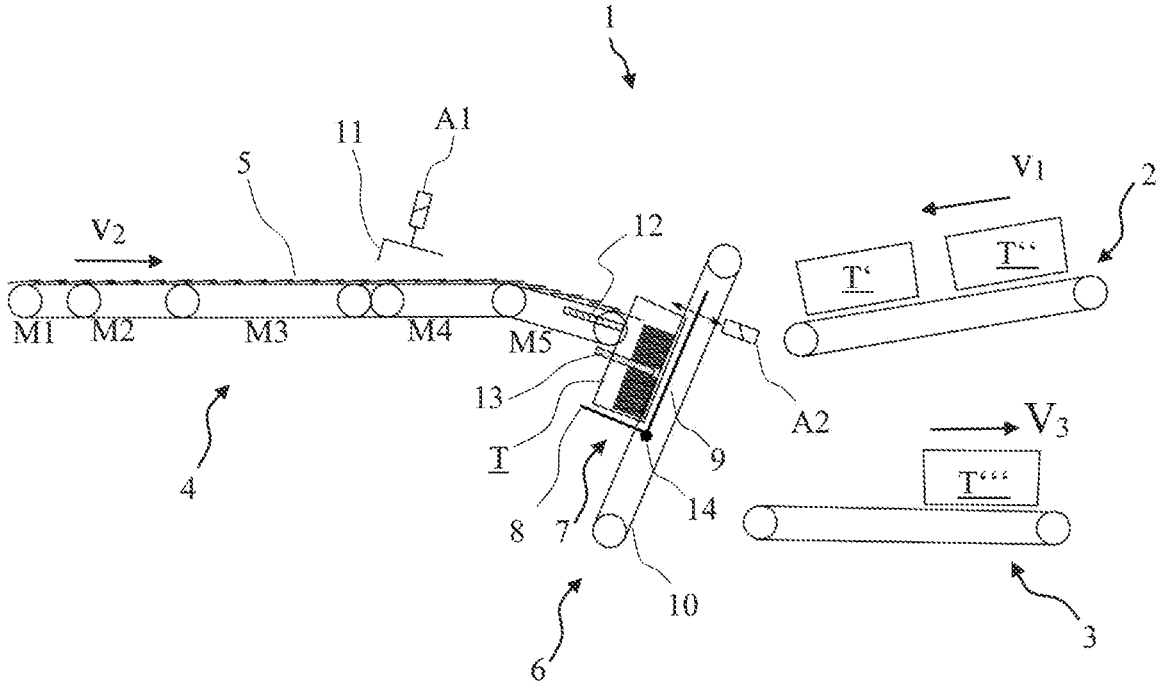
FIG. 1: Sketch of a device for feeding flat objects into a transport container in a side view.

FIG. 1 shows an exemplary sketch of a device 1 according to the invention for feeding flat objects 5 in an upright position into a transport container T. FIGS. 2 to 16 show reduced sketches of the device from FIG. 1 in individual and consecutive process steps of a method according to the invention for feeding the flat objects 5 into the transport container T, whereby individual components of the device 1 have been omitted in FIGS. 2 to 16 merely for the sake of clarity.

The device 1 for feeding flat objects 5 outlined in FIG. 1 comprises a first transport device 2 for transporting transport containers T along a first transport direction v1, a feed device 4 for transporting flat objects 5 along a second transport direction v2 essentially opposite to the first transport direction v1, and a second transport device 3 arranged below the first transport device 2 for transporting transport containers T in a third transport direction v3 running essentially parallel to the second transport direction v2. A receiving device 6 with a container receiving means 7 for receiving a transport container T is arranged between the input device 4 and the transport devices 2, 3.

The first and second transport devices 2, 3 each comprise a motor-driven conveyor device, in particular an endless conveyor belt, on which transport containers T can be transported along the first transport direction v1 and the second transport direction v2, respectively, in a substantially upright transport container position.

Viewed in the second transport direction v2, the input device 4 has several conveyor sections arranged one behind the other, namely a first conveyor section M1, a second conveyor section M2, a third conveyor section M3, a fourth conveyor section M4 and a fifth conveyor section M5. The conveyor sections M1 to M5, which in particular can each comprise endless conveyor belts rotating around driving and deflection rollers, can be driven independently of one another. Via the first conveyor section M1, the flat objects 5 are fed towards the input device 4, in particular from an infeed system (not shown here) connected upstream of the input device 4. Through the downstream fifth conveying section M5, the flat objects 5 are fed into a transport container T arranged in the container receiving means 7. In the present embodiment example, the first to fourth conveying sections M1 to M4 run essentially in a horizontal plane. The fifth conveying section M5 is slightly inclined downward. This favors an input of the flat objects 5 into a transport container T. In the region of the fifth conveying section M5, a first compression element 12 movable substantially along the second conveying direction v2 and insertable into a transport container T arranged in the container receiving means 7 is provided. The first compression element 12 is coupled to a drive (not shown) for performing a movement towards a transport container T placed in the container receiving means 7. Further, the input device 4 has a retaining element 11 arranged above the fourth conveying section M4, which can be brought in and out of engagement (e.g. by an up and down movement) by a first actuator A1 between the third and the fourth conveying sections M3, M4.

The container receiving means 7 of the receiving device 6 has at least one lower contact wall 8 and a receiving base 9, wherein a transport container T inserted into the container receiving means 7 rests with a front side wall against the contact wall 8 and rests with its bottom on the receiving base 9. Preferably, the container receiving means 7 has lateral contact walls, not shown in FIG. 1, for a secure lateral guiding of the transport container T. Via a second actuator A2, the container receiving means 7 can be rotated or pivoted about a pivot axis 14. In an alternative embodiment, it is also conceivable that the entire receiving device 6 is designed to be pivotable, i.e. that further components of the receiving device 6 are also pivoted together with the container receiving means 7.

Via a movement device 10, the container receiving means 7 can be moved between an upper position described in more detail below and a lower position. Further, the receiving device 6 comprises a second compression element 13 which can be inserted into a transport container T arranged in the container receiving device 7. The second compression element 13 is mounted in such a way that it is moved together with the container receiving means 7, in particular during an upward and downward movement, by the movement device 10. In an alternative embodiment not shown here, it is also conceivable that the second compression element 13 is attached to the receiving device 6 in such a way that it is also pivoted together with the container receiving device 7 when the latter is pivoted.

In the following, considering FIGS. 2 to 16, an example of a method according to the invention for feeding the flat objects 5 into the transport container T is described. The method outlined in FIGS. 2 to 16 is carried out in the device 1 of FIG. 1. However, the method according to the invention is not limited to the described embodiment and, in particular, need not to be executed in a device according to FIG. 1. Merely for the sake of clarity, the movement element 10 and the second actuator A2 in FIGS. 2 to 16 as well as the reference signs of the receiving device 6, the contact wall 8, the receiving base 9 and the pivot point 14 are not drawn in FIGS. 2 to 16.

Figure 2:
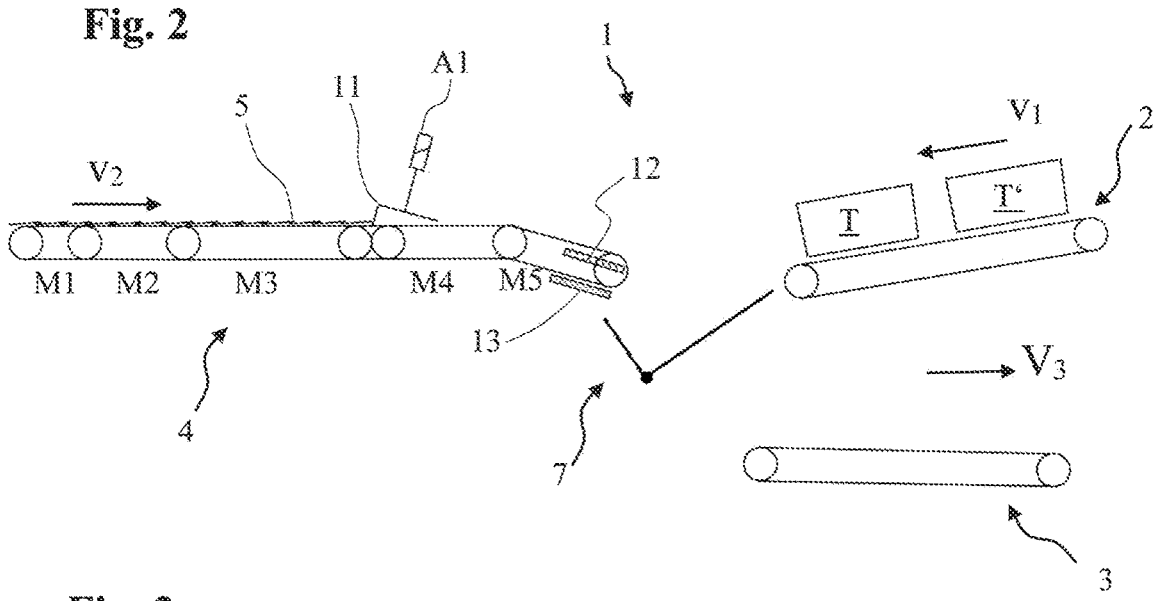
FIGS. 2 to 16: Sketches of the device of FIG. 1 in different process stages of a method for feeding flat objects into a transport container.
Figure 3:
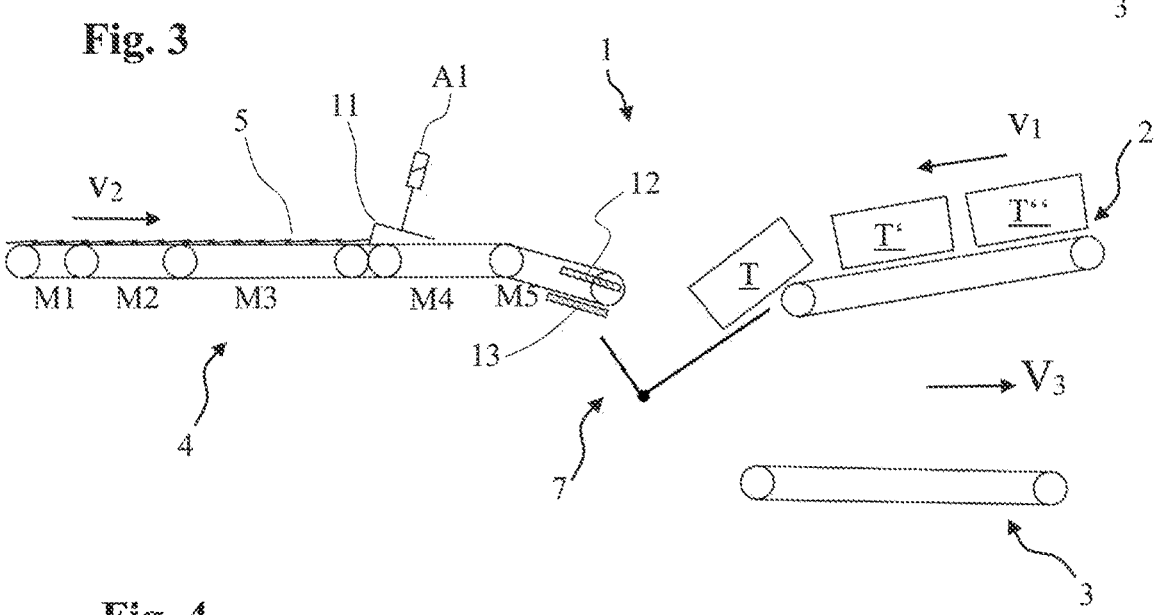

FIG. 2 and FIG. 3 show the transport of a transport container T by the first transport device 2 along the first transport direction v1 and the transfer of the transport container T into the container receiving means 7. For this purpose, the container receiving device 7 is moved to a receiving position shown in FIG. 2 and FIG. 3 for receiving the transport container T provided by the first transport device 2. When the container receiving means 7 is in the receiving position, the first transport device 2 is driven and the transport container T is conveyed along the first transport direction v1 into the container receiving means 7. Subsequent transport containers T', T" are already located in series on the first transport device 2. In the present case, however, the first transport device 2 is driven only during the transfer of the front transport container T and is then stopped until the next transport container T' shall be transferred to the container receiving means 7. In addition to the design shown, other designs of the first transport device 2 are also conceivable, for example a transport of transport containers T in the first transport device 2 using gravity alone and the provision of a limiting element at the end of the first transport device 2 pointing in the direction of the container receiving means 7, which can be introduced in front of one of the following transport containers T', T" in order to retain the following transport containers T', T" and which can be released for the transfer of the next transport container T' to the container receiving means 7, in order to allow a movement of the next transport container T' in the first transport direction v1.

Figure 4:
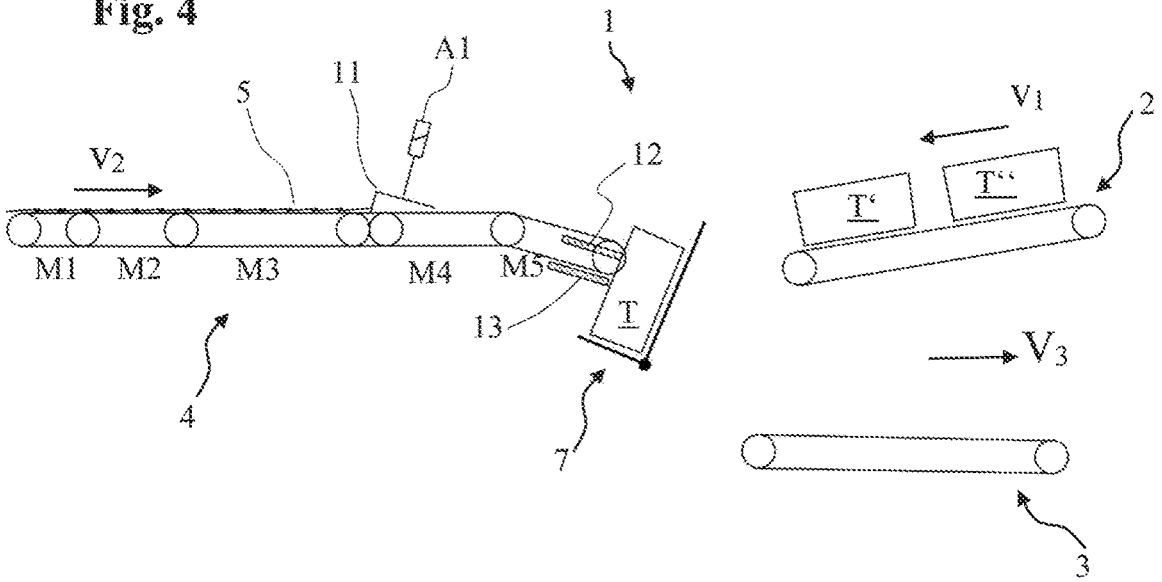
Figure 5:
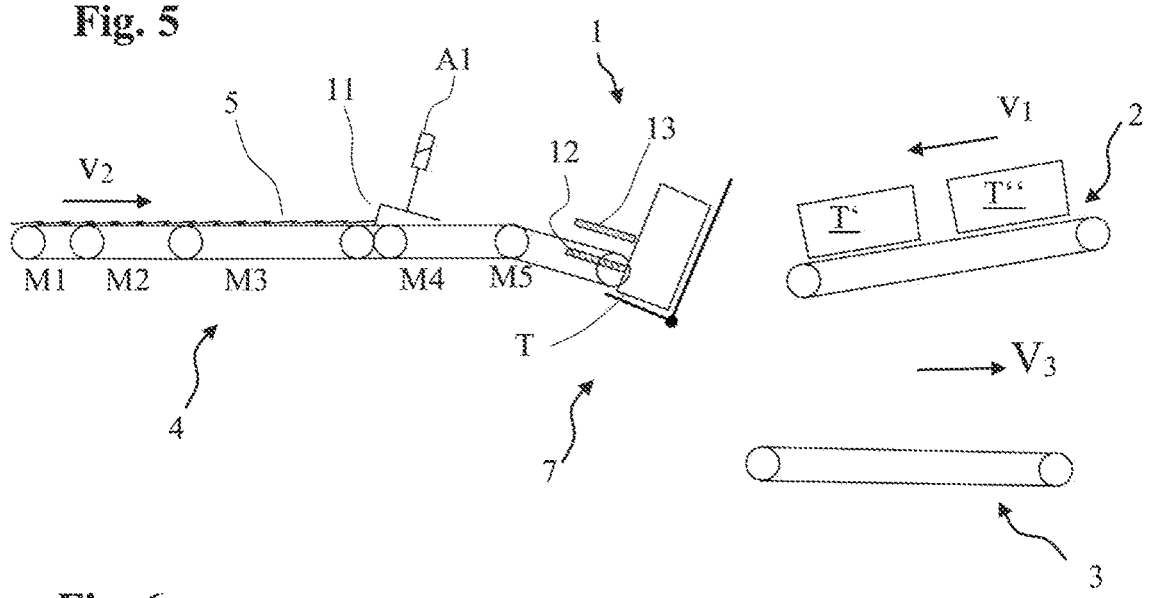

FIG. 4 and FIG. 5 show the movement of the container receiving means 7 from the receiving position shown in FIG. 2 and FIG. 3 to the upper input position shown in FIG. 5. For this purpose, the container receiving means 7 is first pivoted towards the input device 4, as shown in FIG. 4, and then moved upward by the movement device 10 shown in FIG. 1. As shown in FIG. 4 and FIG. 5, when the container receiving means 7 is moved to the upper input position shown in FIG. 5, the second compression element 13 attached to the receiving device 6 moves upwardly together with the container receiving means 7. The first and the second compression elements 12, 13 are configured and arranged in such a way that they do not interfere with each other, in particular not during an upward and downward movement of the container receiving device 7. For example, the compression elements 12, 13 can comprise compressing pins or compressing fingers arranged one behind the other.

As can be seen from FIGS. 2 to 5, while the transport container T is being picked up by the first transport device 2 and the container receiving means 7 is positioned in the upper input position, the retaining element 11 is in a lower position and thereby is blocking the conveyance of flat objects 5 by the input device 4 towards the container receiving means 7.

Figure 6:
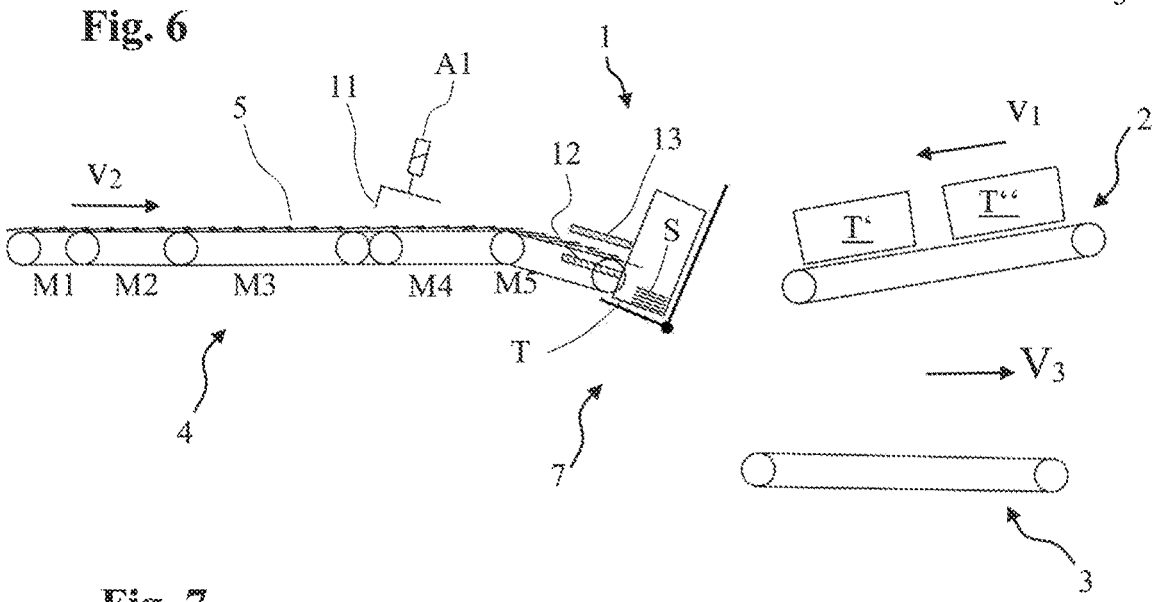

As shown in FIG. 6, when the container receiving means (and the transport container T contained therein) is in the upper input position, the retaining element 11 is moved upward by the first actuator A1 to a release position and the series of flat objects 5 is moved by the conveying sections M1 to M5 of the conveying device in the second transport direction v2 and is finally fed into the transport container T via the fifth conveying section M5. The conveying sections M1 to M5 are thereby preferably all driven at the same conveying speed. The flat objects 5 are thus conveyed serially into the transport container T and stacked flat on top of each other in the transport container T to produce a stack S of flat objects therein, as can be seen in FIGS. 6 and 7.

Figure 7:
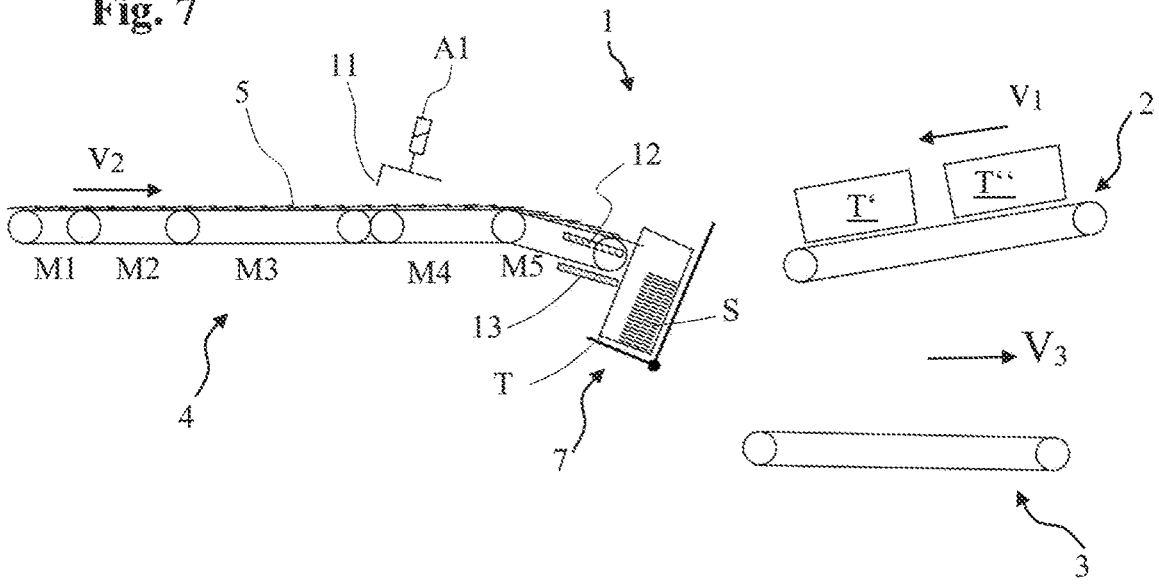

As the filling level of the transport container T increases, the container receiving means 7 is moved downward in steps or continuously, as shown in FIG. 7, to ensure a compact input of the plurality of flat objects 5, in particular a compact stacking of the flat objects 5 on the stack S of flat objects 5 developing inside the transport container T.

Figure 8:
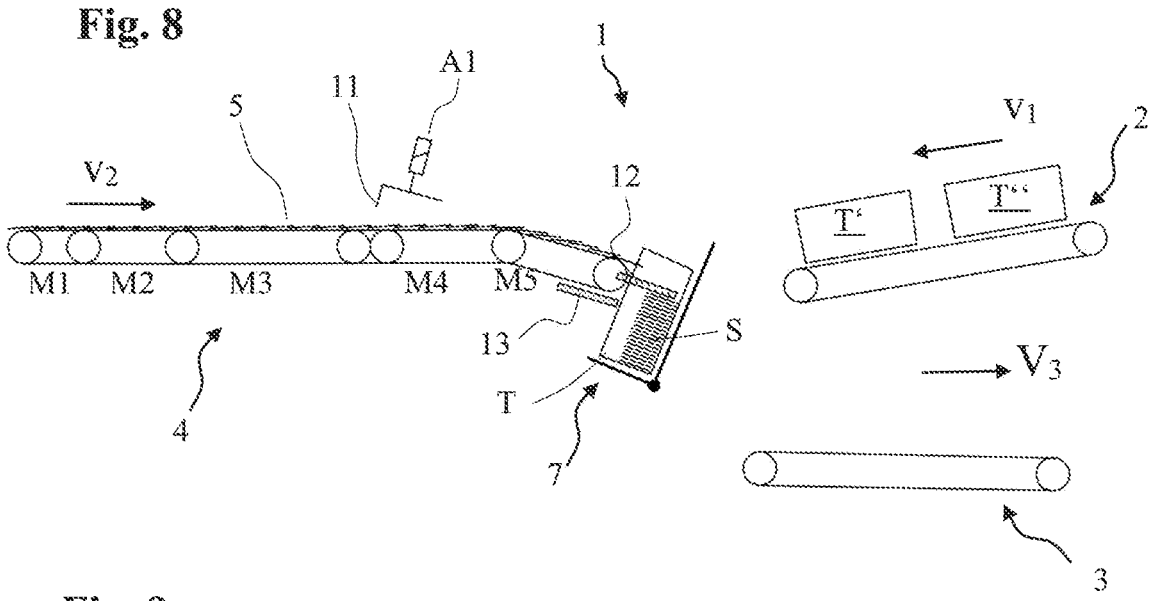
Figure 9:
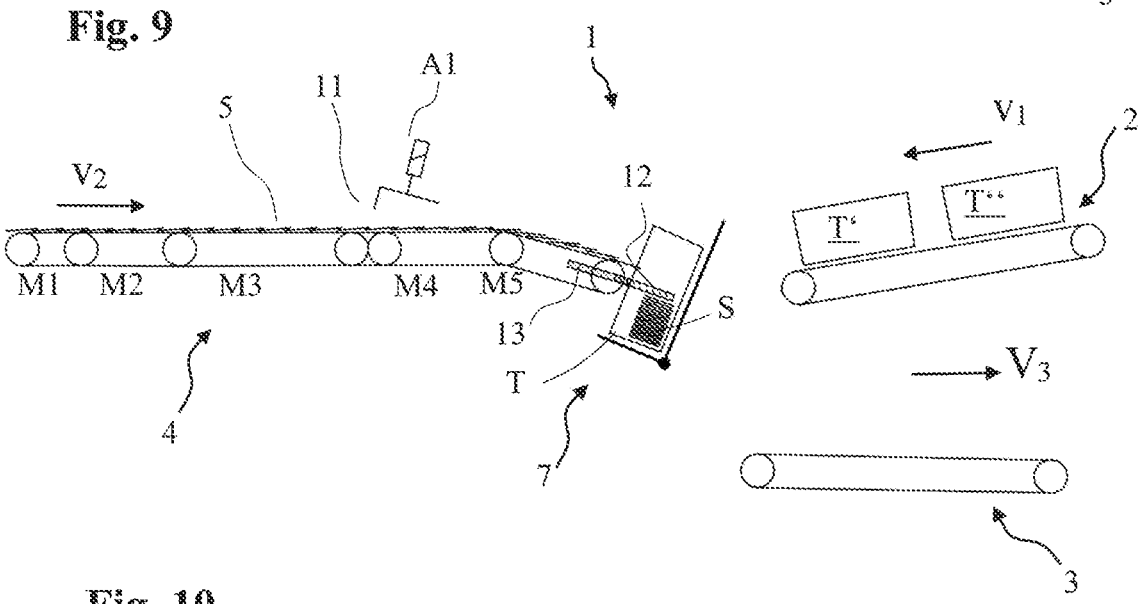

As soon as a certain filling level of the container T is reached, the first compression element 12 arranged on the input device 4 is moved into the transport container T, as shown in FIG. 8. For this purpose, the first compression element 12 is coupled to a drive element that is not shown here. Subsequently, as shown in FIG. 9, a compression of the stack S of flat objects 5 placed in the transport container T takes place by moving the container receiving means 7 upward by means of the movement device 10 (shown in FIG. 1). Here, the compression of the stack S is achieved by pressing the flat objects 5 in the transport container T against the stationary first compression element 12 arranged on the input device 4. As soon as a certain compression is reached, at which in particular the second compression element 13 is at the same height level as the first compression element 12, the movement of the container receiving means 7 is stopped.

Figure 10:
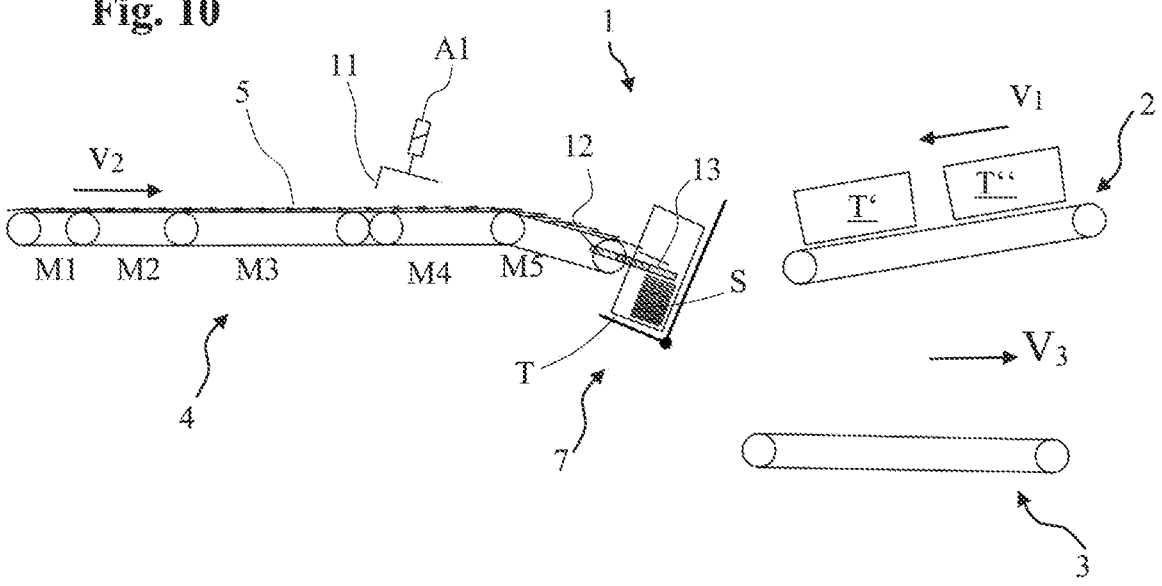
Figure 11:
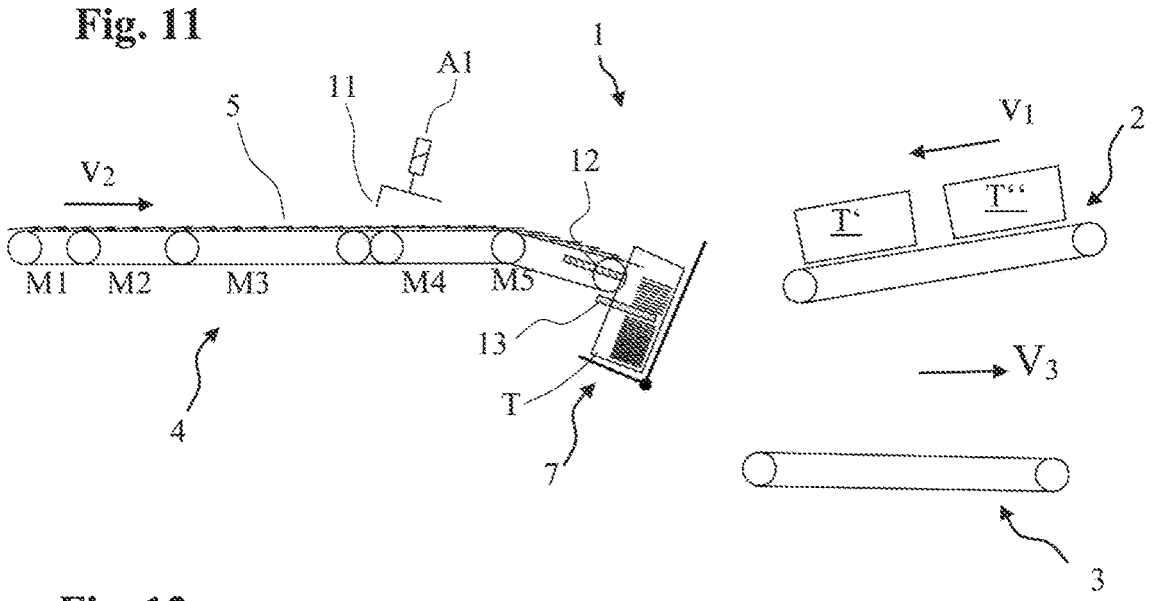

As shown in FIG. 10, the second compression element 13 attached to the receiving device 6 is then introduced into the transport container T, and the first compression element 12 subsequently is removed therefrom. The second compression element 13 introduced into the transport container T ensures that the compression of the stack S of flat objects 5 achieved by the first compression element 12 is upheld. Subsequently, or if necessary, also during the described compression process, further flat objects 5 are inserted serially by the input device 4 into the transport container T, specifically on top of the stack S and above the second compression element 13, as shown in FIG. 10. The container receiving means 7 is then again moved—together with the second compression element 12—downwards in the direction of the lower input position, shown in FIG. 11, in order to obtain an optimal input or placement of further the flat objects 5 on the stack S placed in the transport container T. Contrary to the illustration in the figures, the first and in particular the second compressing elements 12, 13 are preferably designed as thin as possible, for example as thin metal sheets or thin tines of a rake, in order to cause an optimized stacking under an optimal use of the receiving contingent of the transport container T.

Figure 12:
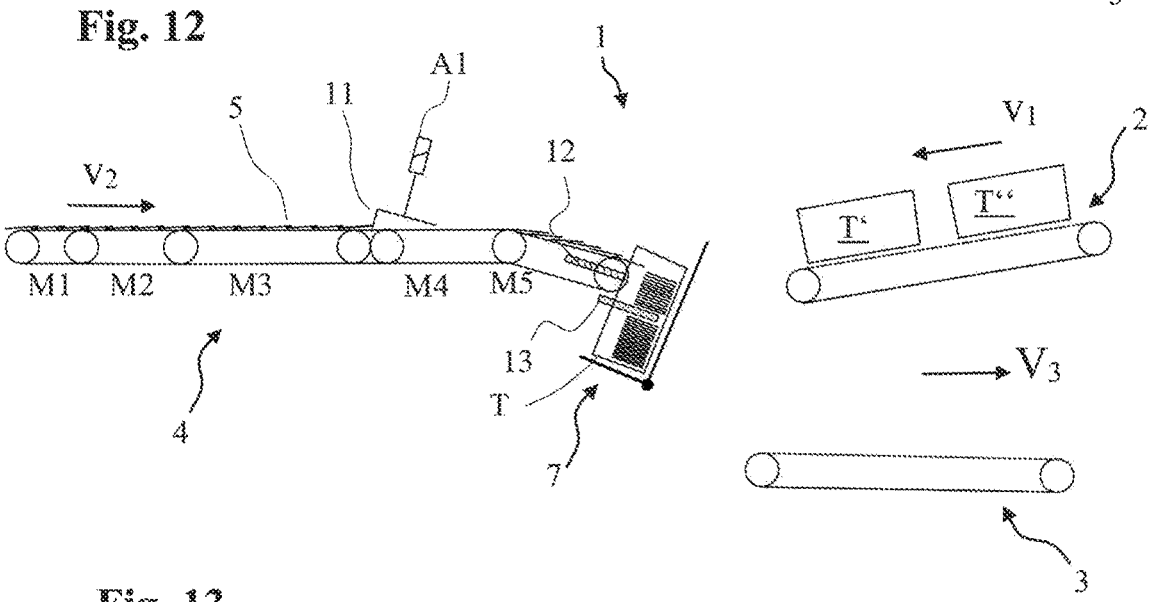
Figure 13:
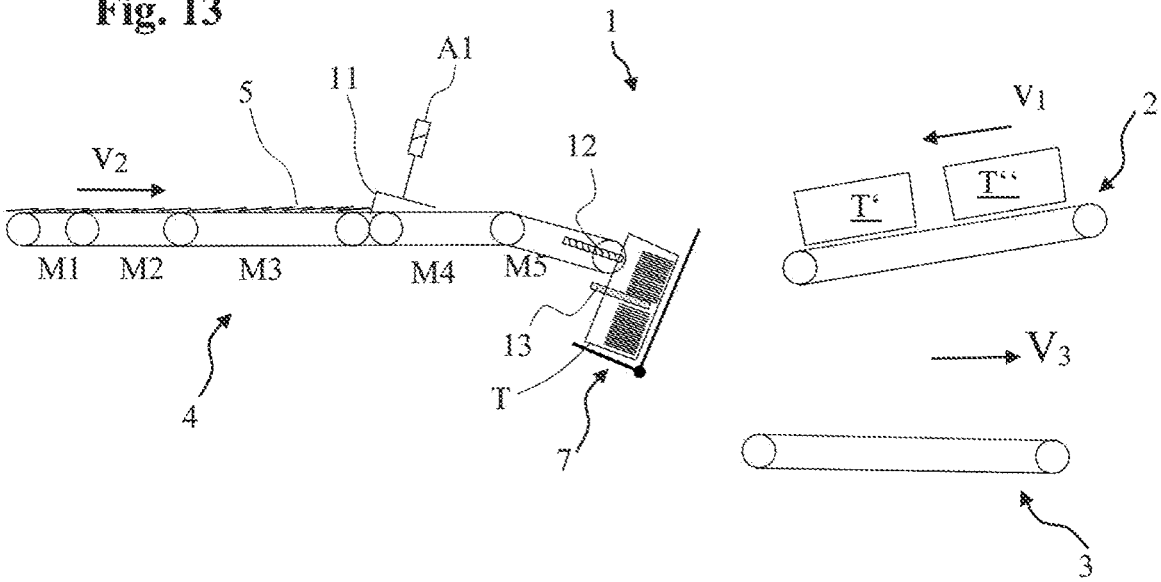

Shortly before a transport container T reaches a predetermined (or maximum) filling level, as shown in FIG. 12, the restraining element 11 is moved downward by the first actuator A1 into a blocking position. Thereby, the serial flow of flat objects 5 conveyed by the input device 4 to the transport container T is interrupted. The flat objects 5 which are on the fourth and fifth conveying sections M4, M5, so downstream of the restraining element 11, are still fed into the transport container T, as shown in FIG. 13. Preferably, the conveying speed of the fourth and fifth conveying sections M4, M5 can be increased for a short time for this purpose, in order to shorten the duration of the required stopping of the serial flow of flat objects 5 arranged in upstream of the retaining element 11.

When none of the flat objects 5 is located on the downstream conveying sections M4 and M5 anymore, the downstream conveying sections M4, M5 can be stopped to save power. For the time that the restraining element 11 is in its blocking position, the conveying speed of the conveying sections M1 to M3 arranged upstream of the restraining element 11 can be reduced. Preferably, the speed at which the conveying sections M2 and M3 are driven preferably is gradually reduced, in particular in such a way that the conveying speed of the third conveying section M3 is lower than the conveying speed of the second conveying section M2. The first conveying section M1 can maintain its conveying speed, so that there is no effect on an infeed system arranged upstream of the input device 4, which feeds the series of flat objects 5 to the input device 4. Due to the retaining element 11 being in its lower blocking position and the described control of the conveying sections M1 to M3, an increasing scaling of the flat objects 5 arranged upstream of the retaining element 11 takes place, as indicated in FIGS. 12 to 16.

Figure 14:
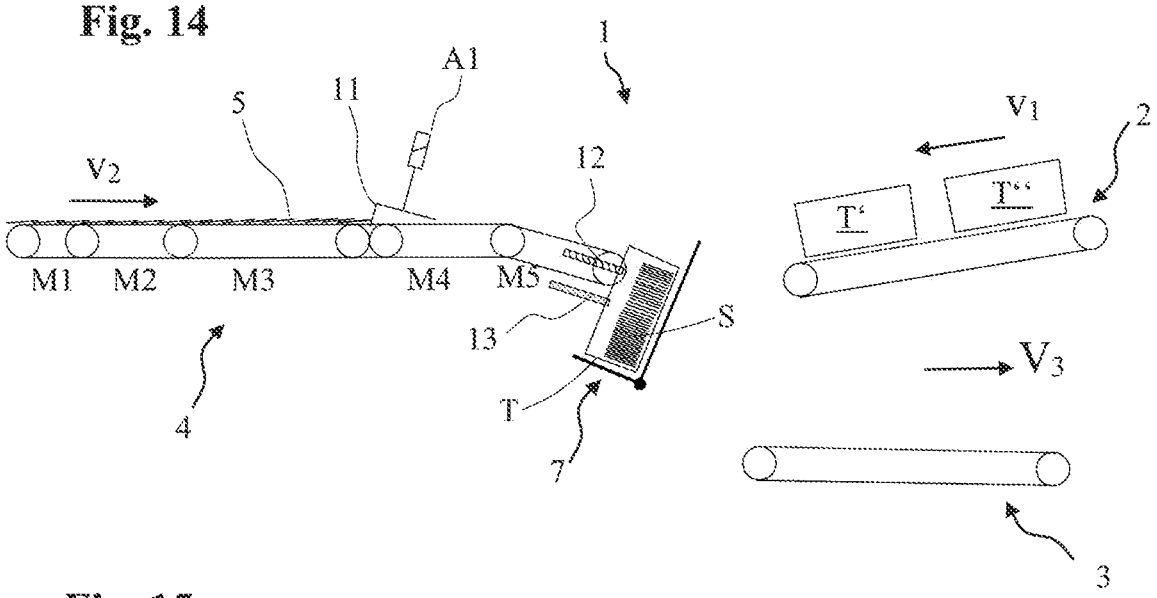
Figure 15:
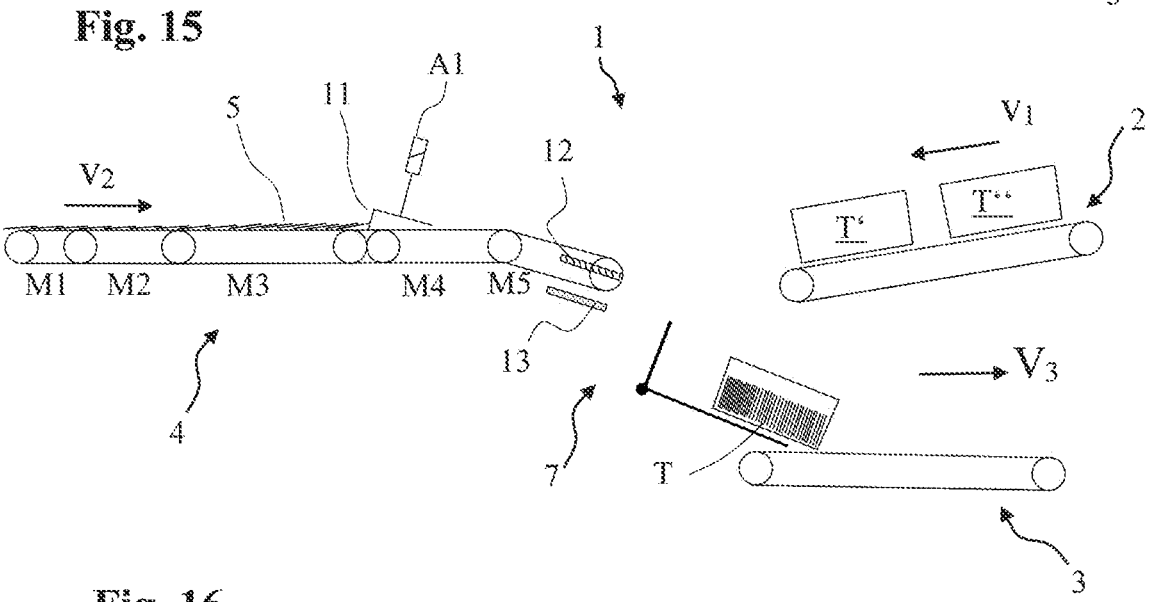
Figure 16:
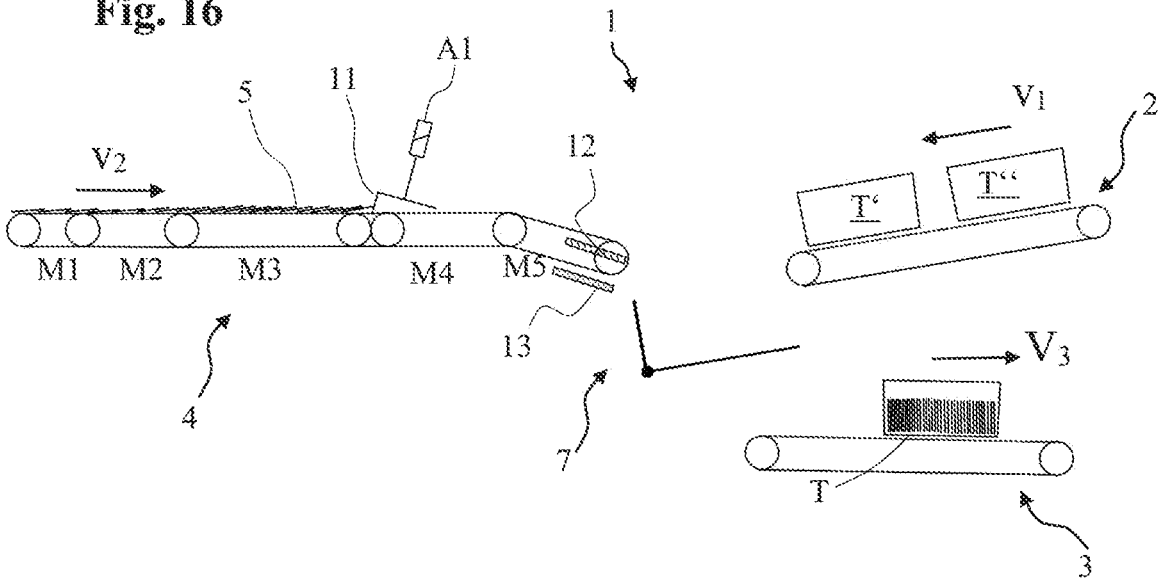

As soon as the transport container T is completely filled (up to a maximum filling level), the second compression element 13 is moved out of the transport container T, as shown in FIG. 14, the container receiving means 7 is swivelled into the delivery position shown in FIG. 15 and the transport container T is delivered to the second transport device 3. Then, as shown in FIG. 16, the container receiving means 7 is moved back to the receiving position, shown in FIG. 2, to receive the next transport container T'. The filled transport container T meanwhile is transported away by the second transport device 3 along the third transport direction v3.

An exemplary device and an exemplary method for feeding flat objects 5 in an upright position into a transport container T is described herein. The invention is not limited to the described example embodiment. Thus, among other things, other control of the restraining element 11, the conveying sections M1 to M5 and the transport devices 2, 3 is possible. For example, the retaining element 11 can be controlled in such a way that it is already moved upwards shortly before a transport container T is in the upper input position, shown in FIG. 5, so that immediately when the container receiving means 7 has reached the upper input position, flat objects 5 are already fed into the container T. This prevents an unnecessary delay or loss of time.

Furthermore, it is also conceivable that the second compression element 13 is arranged on the receiving device 6 in such a way that the receiving device 6 is pivoted together with the container receiving device 7 and, for example, is only brought out of the latter after the container receiving device 7 is in the delivery position. Depending on the positioning of the transport devices 2, 3 and the input device 4, the sequence of movement of the container receiving means 7 can also differ. For example, the container receiving means 7 can already be in the upper input position when pivoting from the receiving position to the input position and/or can be both pivoted and moved upwards when moving from the delivery position to the receiving position. It is also conceivable that the container receiving means 7 is pivoted and moved downward during movement from the lower input position to the delivery position. Further, the device may also have sensors for detecting the filling level. Furthermore, a multiple compression by the first compression element 12 and the use of a plurality of second compression elements 13 is also conceivable.

FIGS. 17 and 18 show embodiments of the device with a movable base element 15 that can be inserted into a transport container T located in the receiving device 6 in an input position, wherein the base element 15 in FIGS. 17 and 18 is located outside the transport container T in an extended position. These embodiments of the device are specifically intended for use with transport containers T having inclined side walls. In the case of such transport containers T, in which at least two opposing side walls form an angle of more than 90° with the bottom of the transport container, there is a risk that a stack S of flat objects stacked in the transport container T, which is in the input position in the device, may slip out of the transport container due to the inclined side walls, in particular the front side wall of the transport container which is at the bottom in the input position. To prevent this, the movable base element 15 is retracted into the transport container T before flat objects 5 are inserted. In this position of the base element 15, which is shown schematically in FIGS. 19A and 19B, the base element 15 serves as a support, arranged at least substantially horizontally or preferably perpendicularly to the bottom of the transport container T, for supporting the stack S of flat objects stacked in the transport container T by serially feeding a plurality of flat objects 5 thereon.

In the embodiment shown in FIG. 17, the base element 15 is designed as a linearly movable plate which is coupled to a drive by means of which the plate of the base element 15 can be retracted into a transport container T located in the container receiving means 7 in the input position, and can be extended again out of the transport container T. In the retracted position of the base element 15, shown in FIGS. 19A and 19B, the plate is in contact with and at least substantially perpendicular to the bottom of the transport container T. In this position of the base element 15, the flat objects 5 can be stacked on the plate of the base element 15, with the generated stack S of flat objects being supported on the one hand by the plate of the base element 15 and on the other hand by the (inclined) bottom of the transport container T. The stack S of flat objects thereby is supported by the plate of the base element 15. This prevents the stack S from slipping out of the transport container T during stacking.

In particular, when stacking of flat objects 5 with different thicknesses on a front side and a rear side, such as envelopes or mail items packed in an envelope, there is a risk of a stack formed by the (filled) envelopes being built up at an angle, if the items are always stacked in the same orientation on the stack S (i.e., for example, always with the thicker front side facing the bottom of the transport container T). This effect is shown schematically in FIG. 19A. As a result, there is a risk that the entire stack S or at least the upper layers of the stack will slip out of the transport container T during stacking, as indicated by an arrow in FIG. 19A. In order to prevent this, the inclination of the base element 15, in particular of the plate which can be moved into the transport container T, can preferably be adjusted relative to a horizontal plane. For this purpose, the plate is hinged to a frame of the base element 15 so as to be pivotable about an axis extending in a horizontal plane, for example. During stacking of the flat objects 5, the inclination of the plate of the base element 15 relative to the horizontal plane can thereby be adjusted so that the upper side of the stack S runs at least substantially horizontally or is inclined downwardly in the direction of the bottom of the transport container T, as shown in FIG. 19B, so that the flat objects 5 in the upper layers of the stack S cannot slip out.

FIG. 18 shows another embodiment of the device with a movable base element 15, wherein the base element 15 in this embodiment can be introduced into a transport container T located in an input position in the device by a pivoting movement. For this purpose, the base element 15 comprises at least one pivotable plate. Preferably, in this embodiment, the base element 15 comprises a first plate pivotally arranged laterally on a first side of the receiving device 6 and a second plate pivotally arranged laterally on a second side of the receiving device 6 opposite to the first side. The first and second plates are thereby coupled to a pivot drive, by means of which the two plates can be pivoted into and out of the transport container, as shown schematically in FIG. 18 by the arrow symbolizing the pivoting movement of one plate. When the two plates of the base element 15 are pivoted into the transport container T, the plates form a support for a stack S with a support surface formed by the top of the two plates, wherein the support surface is at least substantially perpendicular to the bottom of the transport container T (as shown in FIG. 19A). It is convenient that the inclination of the two plates with respect to a horizontal plane or with respect to the bottom of the transport container, as in the embodiment of FIG. 17, is adjustable by means of an inclination drive (as schematically shown in FIG. 19B). Instead of two plates, the base element 15 may also comprise only a single plate, which is pivotally attached to the side of the receiving device 6. However, the design of the base element 15 by two plates has the advantage that the extension of the device in a lateral direction (perpendicular to the transport directions v1, v2, v3) is smaller when the base element 15 is folded out, whereby the device is more compactly constructed.

The invention claimed is:

1. A device for feeding flat objects, including mail items, envelopes, and letters, in an upright position into at least one transport container, the device comprising:

a first transport device for transporting the at least one transport container in a first transport direction;

an input device for transporting flat objects along a second transport direction substantially opposite to the first transport direction;

a second transport device for transporting the at least one transport container in a third transport direction, the second transport device arranged below the first transport device; and a receiving device arranged between the input device and the first and second transport devices, the receiving device having a container receiving device for receiving and at least partially accommodating the at least one transport container within the container receiving device, the container receiving device pivotable from a receiving position for receiving the at least one transport container from the first transport device into a delivery position for delivering the at least one transport container to the second transport device.

2. The device according to claim 1, wherein at least one of the first transport device and the second transport device is configured for transporting the at least one transport container in an upright position, in which a bottom of the at least one transport container is at least substantially in a horizontal position or inclined with respect to a horizontal plane, and the container receiving device is configured for positioning the at least one transport container in an input position, in which the at least one transport container is arranged obliquely or vertically upright with respect to the horizontal plane.

3. The device according to claim 1, wherein the container receiving device is movable from the receiving position into an input position for inputting the flat objects, wherein, in the input position, an open side of the at least one transport container faces in a direction of the input device.

4. The device according to claim 3, wherein the container receiving device is movable between an upper input position and a lower input position by a movement device.

5. The device according to claim 3, wherein the input device engages at least partially in the at least one transport container in the input position of the container receiving device.

6. The device according to claim 1, wherein the third transport direction is at least substantially parallel to the second transport direction, or the third transport direction and the second transport direction enclose an angle of less than 45°.

7. The device according to claim 1, wherein the input device has at least one conveyor device for transporting the flat objects in singulated form or in a scaling overlapping arrangement.

8. The device according to claim 1, wherein the input device has at least two conveyor sections which can be operated independently of one another or at different speeds.

9. The device according to claim 8, wherein the input device includes a retaining element between or inserted within the at least two conveyor sections of the input device, the retaining element configured for retaining and scaling up the flat objects transported by the input device.

10. The device according to claim 1, further comprising a movable base element movable into and arranged within the at least one transport container located in the container receiving device, wherein the movable base element is configured as a support for a stack of flat objects produced by feeding a plurality of flat objects into the at least one transport container.

11. The device according to claim 1, wherein the container receiving device further comprises at least one of:

a receiving base configured for supporting a bottom of the at least one transport container;

a lower contact wall configured for supporting a first side wall of the at least one transport container;

a lateral contact wall configured for guiding a side wall of the at least one transport container; and a suction device for fixing the at least one transport container at least partially within the container receiving device.

12. A device for feeding flat objects, including mail items, envelopes, and letters, in an upright position into at least one transport container, the device comprising:

a first transport device for transporting the at least one transport container in a first transport direction;

an input device for transporting flat objects along a second transport direction substantially opposite to the first transport direction;

a second transport device for transporting the at least one transport container in a third transport direction, the second transport device arranged below the first transport device; and a receiving device arranged between the input device and the first and second transport devices, the receiving device having a container receiving device for receiving and at least partially accommodating the at least one transport container within the container receiving device, the container receiving device pivotable from a receiving position for receiving the at least one transport container from the first transport device into a delivery position for delivering the at least one transport container to the second transport device, wherein at least one of the input device and the receiving device comprises at least one compression unit, the at least one compression unit having at least one compression element configured for insertion into the at least one transport container during insertion of the flat objects and which is arranged for compressing a stack of flat objects inserted into the at least one transport container.

13. A method for feeding flat objects, in an upright position, into at least one transport container, the method comprising:

transporting the at least one transport container by a first transport device along a first transport direction;

receiving the at least one transport container by a container receiving device positioned in a receiving position, the container receiving device at least partially accommodating the at least one transport container within the container receiving device;

feeding a plurality of flat objects into the at least one transport container, using an input device, the input device configured for transporting a series of flat objects in a direction of a second transport direction substantially opposite to the first transport direction;

swiveling the container receiving device together with the at least one transport container at least partially accommodated within the container receiving device into a delivery position; and delivering the at least one transport container in the delivery position to a second transport device, which is arranged below the first transport device and is designed for transporting the at least one transport container, filled with the plurality of flat objects, in a direction of a third transport direction.

14. The method according to claim 13, further comprising moving the container receiving device from the receiving position into an input position for delivering the plurality of flat objects fed by the input device into the at least one transport container, wherein the container receiving device is moved together with the at least one transport container at least partially accommodated within the container receiving device from an upper input position to a lower input position, during feeding of the plurality of flat objects into the at least one transport container.

15. The method according to claim 13, wherein the input device has a retaining element and at least two independently drivable conveyor sections arranged in front of the retaining element, the method further comprising operating the conveyor sections at decreasing conveyor speed, as viewed in a direction of the retaining element, during exchange of the at least one transport container filled to a predefined fill level with the plurality of flat objects with an empty transport container.

16. The method according to claim 13, further comprising compressing the plurality of flat objects inserted into the at least one transport container after or during feeding of the plurality of flat objects into the at least one transport container, wherein compressing includes inserting a first compressing element into the at least one transport container and inserting a second compressing element into the at least one transport container, wherein the first compressing element is arranged at the input device and the second compressing element is arranged at the receiving device.

17. The method according to claim 16, wherein the compressing is performed during feeding of the flat objects into the at least one transport container, the compressing comprising:

inserting the first compression element into the at least one transport container, moving the container receiving device upwards, thereby compressing a stack of flat objects inserted in the at least one transport container using the first compression element, stopping upward movement of the container receiving device, as soon as a predefined degree of compression of the stack of flat objects is reached, inserting the second compression element into the at least one transport container on top of the compressed stack of flat objects, removing the first compression element from the at least one transport container, moving the container receiving device downwards while feeding flat objects into the at least one transport container and onto the second compression element, and stopping the feeding of flat objects and removing the second compression element from the at least one transport container when a predefined fill level of the at least one transport container with a plurality of flat objects is reached.

18. The method according to claim 13, further comprising moving the container receiving device from the delivery position into the receiving position for receiving an empty transport container after the at least one transport container has been filled to a predefined fill level with the plurality of flat objects and has been transferred to the second transport device.

19. The method according to claim 13, further comprising moving a movable base element into the at least one transport container at least partially accommodated in the container receiving device after the at least one transport container has been received by the container receiving device and producing a stack of flat objects by feeding flat objects into the at least one transport container onto the movable base element.

20. The method according to claim 13, further comprising at least one of:

interrupting or delaying transport of the plurality of flat objects by the input device in a direction of the at least one transport container during transport of the at least one transport container to the second transport device when the at least one transport container is filled to a predefined fill level with the plurality of flat objects; and scaling up of the plurality of flat objects transported by the input device during transport of the at least one transport container to the second transport device when the at least one transport container is filled to a predefined fill level with the plurality of flat objects.

* * * * *